US006491135B2

(12) United States Patent
Lee

(10) Patent No.: US 6,491,135 B2
(45) Date of Patent: Dec. 10, 2002

(54) PORTABLE ANCHORAGE POINT ASSEMBLY

(75) Inventor: David C. Lee, Houston, TX (US)

(73) Assignee: Protecta International, Inc., Houston, TX (US)

( * ) Notice: Subject to any disclaimer, the term of this patent is extended or adjusted under 35 U.S.C. 154(b) by 0 days.

(21) Appl. No.: 09/833,087

(22) Filed: Apr. 11, 2001

(65) Prior Publication Data

US 2002/0148680 A1 Oct. 17, 2002

(51) Int. Cl.[7] ..... A47L 3/04; E04G 3/14; A47F 5/00

(52) U.S. Cl. ..... 182/3; 182/36; 248/299

(58) Field of Search ..... 182/36, 3, 127; 248/499, 237; 24/68 R, 265 R, 68 CD, 19, 69 CL

(56) References Cited

U.S. PATENT DOCUMENTS

| | | | | | |
|---|---|---|---|---|---|
| 4,008,669 | A | * | 2/1977 | Sumrell | 248/499 X |
| 4,058,291 | A | * | 11/1977 | Schreyer et al. | 24/68 CD X |
| 4,799,296 | A | * | 1/1989 | Rasmussen | 24/68 R |
| 4,928,790 | A | | 5/1990 | Franks | 182/3 |
| 5,054,576 | A | * | 10/1991 | Glynn | 182/3 |
| 5,092,426 | A | | 3/1992 | Rhodes | 182/3 |
| 5,131,620 | A | * | 7/1992 | Boundy | 248/499 X |
| 5,165,499 | A | | 11/1992 | Bell | 182/9 |
| 5,287,944 | A | * | 2/1994 | Woodyard | 182/3 |
| 5,809,620 | A | * | 9/1998 | Crowley et al. | 24/68 CD X |
| 6,053,279 | A | | 4/2000 | McKenna | 182/36 |
| 6,092,623 | A | | 7/2000 | Collavino | 182/3 |
| 6,098,746 | A | | 8/2000 | Castaneda | 182/45 |
| 6,176,056 | B1 | * | 1/2001 | MacKarvich | 248/499 X |

* cited by examiner

*Primary Examiner*—Daniel P. Stodola
*Assistant Examiner*—Hugh B. Thompson
(74) *Attorney, Agent, or Firm*—IPLM Group, P.A.

(57) ABSTRACT

A portable anchorage point assembly for use with structures such as railroad tank cars. A base plate having straps extending therefrom includes a rubber base, which is placed on the top surface of the tank car. The rubber base prevents the base plate from slipping on the surface of the tank car. The straps extend around the body of the tank car and are each secured to an I-beam or similar structure at the bottom of the tank car by a load binder assembly and a web sling secured about the I-beam. Once the assembly has been secured about the body of the tank car, one end of a safety line may be attached to the base plate of the portable anchorage point assembly.

12 Claims, 3 Drawing Sheets

FIG. 2
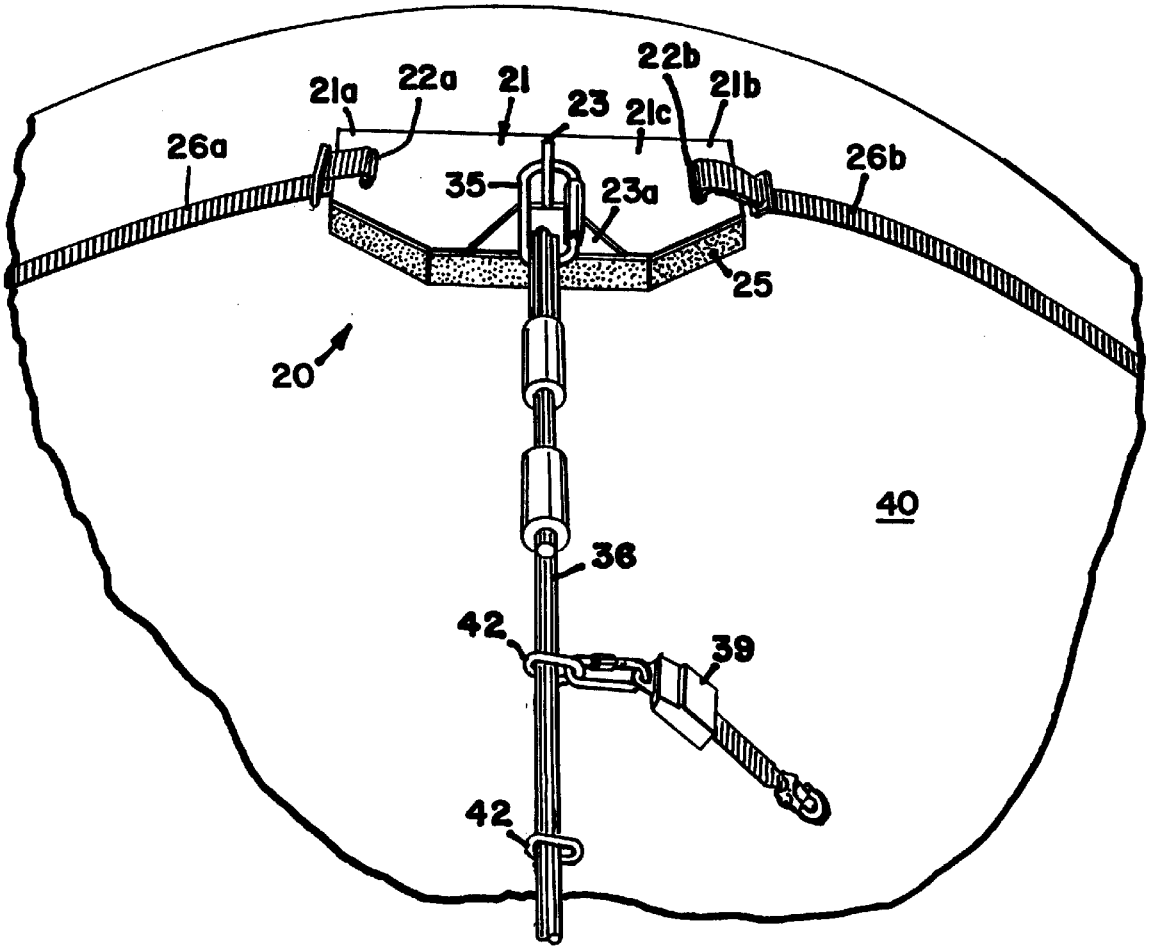
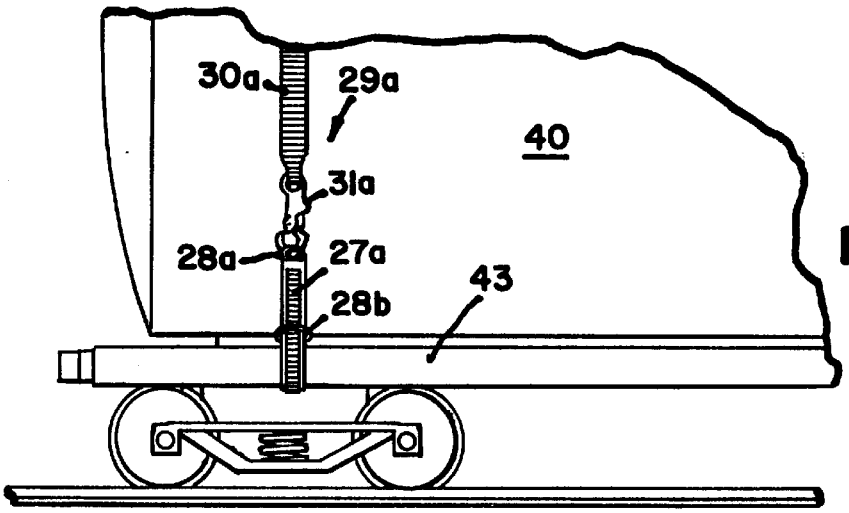
FIG. 3

FIG. 4
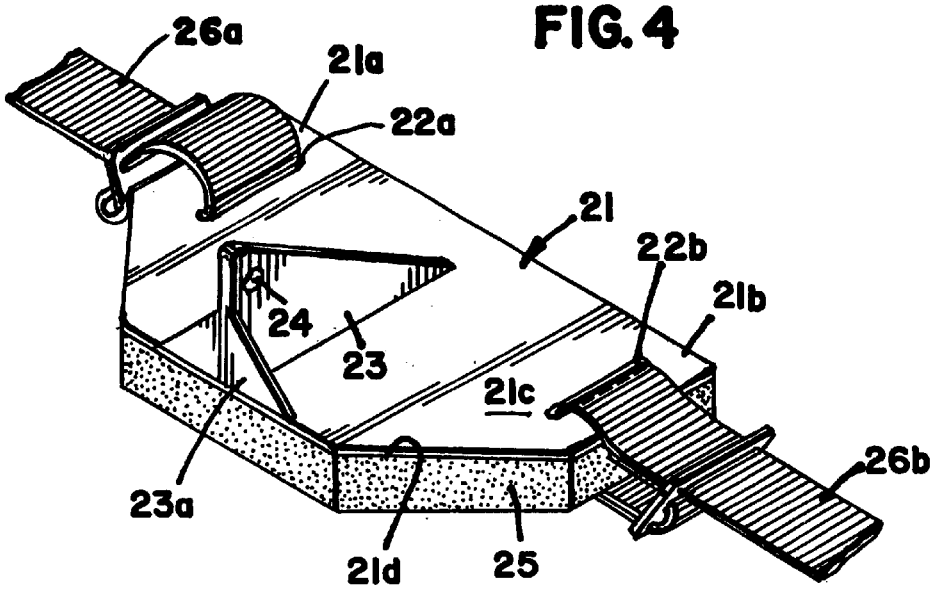
FIG. 5
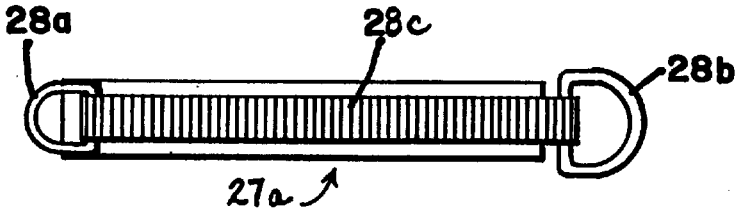
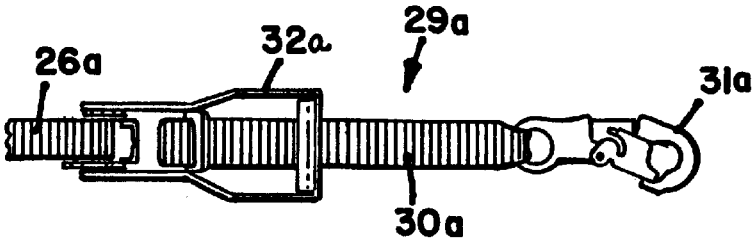
FIG. 6

PORTABLE ANCHORAGE POINT ASSEMBLY

BACKGROUND OF THE INVENTION

1. Field of the Invention

The present invention relates to a portable anchorage point assembly for use with structures such as railroad tank cars.

2. Description of the Prior Art

Various occupations place people in precarious positions at relatively dangerous heights, thereby creating a need for fall-arresting safety apparatus. Among other things, such apparatus may include a horizontal lifeline interconnected between two anchorage points, and a person working in proximity to the horizontal lifeline is secured thereto. Obviously, the horizontal lifeline and the anchorage points must be secure enough to provide fall protection for workers during horizontal movement along the length of the horizontal lifeline. However, this may be more difficult when workers are working on structures such as railroad tank cars because the anchorage points are difficult to secure.

Routine inspections or light maintenance on railroad tank cars are examples of precarious positions in which workers are working at relatively dangerous heights requiring the use of fall-arresting safety apparatus. Previously, portable, secure anchorage points were not readily available for use with structures such as railroad tank cars. Although railroad tank cars include a structure on the top of the car to which one end of a horizontal lifeline may be secured, securing the other end of the horizontal lifeline to the car is not feasible. The present invention provides a portable, secure anchorage point to which the other end of the horizontal lifeline may be secured thereby providing fall protection for workers during horizontal movement along the length of the horizontal lifeline.

SUMMARY OF THE INVENTION

In a preferred embodiment portable anchorage point assembly for securing an end of a temporary horizontal lifeline to a structure, a base plate includes a top, a bottom, a first side and a second side. A base is operatively connected to the bottom of the base plate. A first strap extends from the first side of the base plate, and a second strap extends from the second side of the base plate. A securing member adjusts and secures the straps to the structure. An attachment member proximate the top of the base plate provides means for attaching the end of the horizontal lifeline to the base plate.

In a preferred embodiment portable anchorage point assembly in contact with a surface of a structure for use with a safety line, a base plate includes a top, a bottom, a first side and a second side. A base is operatively connected to the bottom of the base plate and in contact with the surface of the structure to prevent the base plate from sliding on the surface of the structure. A first flexible elongate member extends from the first side of the base plate, and a second flexible elongate member extends from the second side of the base plate. A first load binder assembly adjusts and secures the first flexible elongate member to the structure, and a second load binder assembly adjusts and secures the second flexible elongate member to the structure. An attachment member proximate the top of the base plate provides means for attaching a safety line to the base plate.

In a preferred embodiment method of securing an end of a safety line to a structure, a base plate is placed on the structure. The base plate includes a top and a base, and the base contacts the structure and prevents the base plate from sliding on the structure. The base plate has a first strap and a second strap extending therefrom. The first strap and the second strap are secured to the structure. The safety line is attached to an attachment member, and the attachment member is proximate the top of the base plate and is operatively connected thereto.

In a preferred embodiment method of securing an end of a temporary horizontal lifeline to a structure having a first side, a second side, and a bottom, a base plate is placed on the structure. The base plate has a top and a base, and the base contacts the structure and prevents the base plate from sliding on the structure. A first strap is attached to a first end of the base plate, and the first strap extends from the base plate along the first side of the structure. A second strap is attached to a second end of the base plate, and the second strap extends from the base plate along the second side of the structure. A first sling is secured about the bottom of the first side of the structure, and a second sling is secured about the bottom of the second side of the structure. The first sling is connected to said first strap with a first load binder assembly, and the second sling is connected to said second strap with a second load binder assembly. The first strap is tightened through the first load binder assembly and the second strap is tightened through the second load binder assembly thereby fastening the base plate securely to the structure. The end of the temporary horizontal lifeline is attached to the structure.

In a preferred embodiment portable anchorage point assembly for use with a railroad tank car having a first I-beam and a second I-beam for securing an end of a temporary horizontal lifeline thereto, a base plate includes a top, a bottom, a first side and a second side. Abase is operatively connected to the bottom of the base plate and contacts the railroad tank car to prevent the base plate from sliding about on the railroad tank car. A first strap is operatively connected to the first side of the base plate, and a second strap is operatively connected to the second side of the base plate. A first web sling is secured about the first I-beam, and a second web sling is secured about the second I-beam. A first load binder assembly interconnects the first strap and the first web sling, and a second load binder assembly interconnects the second strap and the second web sling. An attachment member is operatively connected to the base plate and provides a surface to which the end of the temporary horizontal lifeline may be attached and secured thereto.

BRIEF DESCRIPTION OF THE DRAWINGS

FIG. 2 is a top view of the portable anchorage point assembly on the railroad tank car shown in FIG. 1.

FIG. 3 is a side elevational view of the portable anchorage point assembly on the railroad tank car shown in FIG. 1.

FIG. 4 is a perspective view of a base plate of the portable anchorage point assembly shown in FIG. 1.

FIG. 5 is a top view of a web sling of the portable anchorage point assembly shown in FIG. 1.

FIG. 6 is a top view of a load binder assembly of the portable anchorage point assembly shown in FIG. 1.

DETAILED DESCRIPTION OF THE PREFERRED EMBODIMENT

Figure 1:
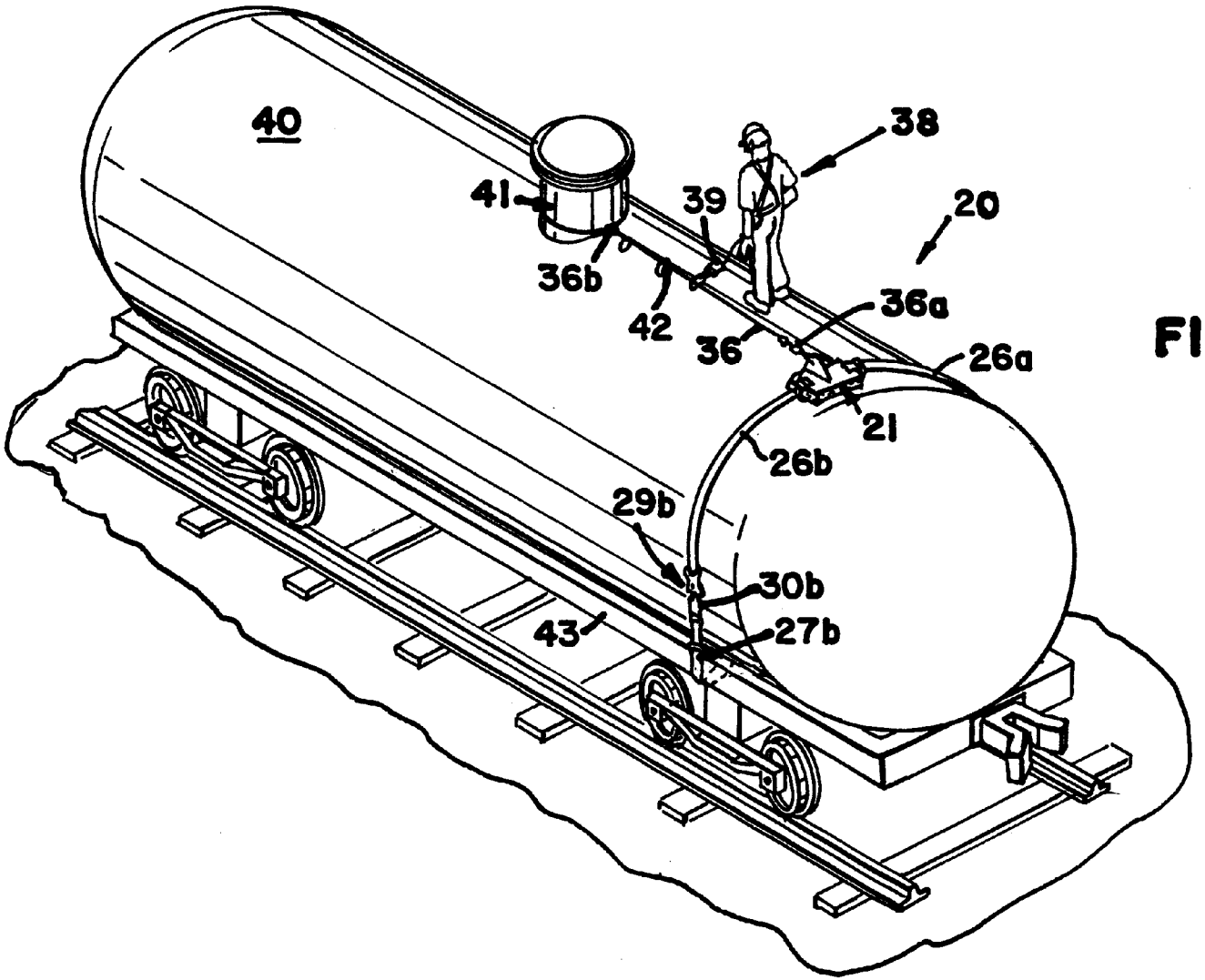
FIG. 1 is a perspective view of a portable anchorage point assembly on a railroad tank car for use with a horizontal lifeline constructed according to the principles of the present invention.

With reference to the drawings, wherein like reference numerals designate like parts and assemblies throughout the several views, a preferred embodiment portable anchorage point assembly constructed according to the principles of the present invention is designated by the numeral 20.

The present invention is a portable anchorage point assembly 20 for attaching a first end 36*a* of a temporary horizontal lifeline 36 when doing tasks such as inspections or light maintenance on a structure such as a railroad tank car 40, a railroad hopper car, or a similar structure. The horizontal lifeline 36 is used for fall protection for a worker 38 working on top of the tank car 40, as shown in FIG. 1. Although the present invention is shown as being used in conjunction with a tank car 40 and a temporary horizontal lifeline 36, it is understood that the present invention may also be used in conjunction with other similar structures of varying sizes to provide an anchorage point to which an end of a safety line may be similarly attached for fall-arrest purposes. Examples of other such structures include fixed horizontal tanks and vessels such as large propane storage tanks and eighteen wheel tank trucks.

The portable anchorage point assembly 20 includes a base plate 21, which has a first side 21*a*, a second side 21*b*, a top 21*c*, and a bottom 21*d*. The base plate 21 is shown in greater detail in FIGS. 2 and 4. A rubber base 25 is operatively connected to the bottom 21*d* of the base plate 21 to prevent the base plate 21 from slipping and sliding about on the top surface of the tank car 40. In the preferred embodiment, the base plate 21 and the rubber base 25 are generally rectangular shaped components having a length of approximately ten inches and a width of approximately six inches. The first side 21*a* and the second side 21*b* are located on either end of the generally rectangular shaped base plate 21. In the preferred embodiment, the base plate 21 is made of galvanized steel, and the rubber base 25 is made of polyurethane, which has a high coefficient of friction to prevent slippage of the base plate 21 on the tank car 40. The base plate 21 and the base 25 may be made of other suitable materials known in the art.

An attachment member 23 is operatively connected to and protrudes from the top 21*c* of the base plate 21 proximate the center of the base plate 21 and resembles a T-shaped flange. The top of the "T" forms a support member 23*a*, which provides additional support and strength to the attachment member 23. The attachment member 23 also includes a hole 24 proximate the support member 23*a*. The hole 24 provides a structure to which the first end 36*a* of the horizontal lifeline 36 may be attached by a hook 35.

The base plate 21 also includes a slot 22*a* on its first side 21*a* and a slot 22*b* on its second side 21*b*, and attachment member 23 is located between the slots 22*a* and 22*b* running parallel thereto. The slots 22*a* and 22*b* are approximately two inches long. One end of a first strap 26*a* is secured to slot 22*a* and one end of a second strap 26*b* is secured to slot 22*b* of the base plate 21. Each strap 26*a* and 26*b* is a flexible elongate member approximately two inches wide and is long enough to be wrapped around the sides of the tank car 40. In the preferred embodiment, each strap 26*a* and 26*b* is approximately twenty-two feet long and is made of nylon. The other end of strap 22*a* is threaded through a load binder 32*a*, which is attached to a load binder assembly 29*a* that acts as a securing member for adjusting and securing the strap 22*a*. The load binder assembly 29*a* includes a web strap 30*a* that interconnects the load binder 32*a* and a snap hook 31*a*. Likewise, the other end of strap 22*b* is threaded through a load binder 32*b*, which is attached to a load binder assembly 29*b*. The load binder assembly 29*b* includes a web strap 30*b* that interconnects the load binder 32*b* and a snap hook 31*b*. In the preferred embodiment, the web straps 30*a* and 30*b* are approximately two feet long. The load binders 32*a* 32*b* are well known in the art and are disclosed in U.S. Pat. Nos. 5,282,296 and 5,560,086, which are incorporated herein by reference, and securing the straps 22*a* and 22*b* to the respective load binders 32*a* and 32*b* is also well known in the art. The snap hooks 31*a* and 31*b* are also well known in the art. The load binder assemblies 29*a* and 29*b* are shown in greater detail in FIGS. 3 and 6.

Two web slings 27*a* and 27*b* having a width of approximately two inches and a length of approximately two feet are attached to a structure on the tank car 40 proximate the bottom of the tank car 40 such as an I-beam 43, a rail, or a similar structure. The web slings 27*a* and 27*b* are shown in greater detail in FIGS. 3 and 5. A smaller D-ring 28*a* is attached to one end of each of the web sling straps 28*c* and a larger D-ring 28*b* is attached to the other end of each of the web sling straps 28*c*. The larger D-rings 28*b* are large enough to slide over the smaller D-rings 28*a* and the web straps 28*c*. To form a sling, the web strap 28*c* is placed around the I-beam 43 and the smaller D-ring 28*a* is placed through the larger D-ring 28*b* thereby forming a loop about the I-beam 43. The larger D-ring 28*b* will slide along the web sling strap 28*c* to tighten the loop about the I-beam 43. Then, the smaller D-rings 28*a* are each attached to the respective snap hooks 31*a* and 31*b* at the ends of the load binder assemblies 29*a* and 29*b*.

To install and utilize the portable anchorage point assembly 20, the first end 36*a* of the temporary horizontal lifeline 36 is attached to the hole 24 in the base plate 21 by the hook 35 or by some other attachment means well known in the art. From ground level, one rolled up end of the web strap 26*a* opposite the end secured to the base plate 21 is tossed over the body of the tank car 40. As the rolled up end is thrown, it unwinds across the top of the body of the tank car 40. On the other side of the tank car 40, the unwound end of the web strap 26*a* may be pulled to center the base plate 21 on the top of the tank car 40 with the rubber base 25 between the tank car 40 and the base plate 21. The rubber base 25 ensures that the base plate 21 will not slip on the surface of the tank car 40. Next, one web strap sling 27*a* is placed around the lower tank car structure such as an I-beam 43 or a rail, which is able to withstand 5,000 pound loads. Then, the smaller D-ring 28*a* is placed through the larger D-ring 28*b* thereby forming a loop with the web sling strap 28*c* about the I-beam 43. The larger D-ring 28*b* slides along the web sling strap 28*c* to tighten the loop about the I-beam 43. The smaller D-ring 28*a* is then attached to the snap hook 31*a* of the load binder assembly 29*a*. This is then repeated for the other side of the tank car 40 for the web strap sling 27*b*. Then, the loose ends of the straps 26*a* and 26*b* coming down from the base plate 21 are fed through the respective load binders 32*a* and 32*b* and the straps 26*a* and 26*b* are tensioned by means well known in the art. The tension should be set as tightly as possible by hand. This completes the assembly of the portable anchorage point assembly 20.

To attach the second end 36*b* of the temporary horizontal lifeline 36 to the attachment structure 41 on the top of the tank car 40, it is necessary to get on top of the tank car 40. This may be accomplished by climbing the ladder located proximate the center of the tank car 40 while carrying the loose, second end 36*b* of the temporary horizontal lifeline 36. The second end 36*b* of the horizontal lifeline 36 may then be attached by means well known in the art to the suitable anchor point attachment structure 41 on the tank car 40 that meets the rating of the horizontal lifeline 36, which is usually approximately 5,000 pound loads. Although the structure 41 is shown in FIG. 1 as being a round structure to which the second end 36*b* is attached, it is understood that the structure 41 will vary depending upon which type of tank car 40 is being used. Any structure capable of providing secure support for one end of a horizontal lifeline may serve as an anchor point attachment structure 41 in the present invention. The structure 41 could include a central flange or a bracket on the tank car 40. Depending upon the structure 41 on the tank car 40, a web sling, a wire rope sling, a hook, or a carabiner may be required to attach the second end 36*b* to the structure 41, and this is well known in the art. The temporary horizontal lifeline system 36 must then be tensioned, and this is also well known in the art. Finally, the worker 38 donning a suitable safety harness should utilize a connector 39 such as a small self-retracting lifeline operatively connected to the ring 42 on the temporary horizontal lifeline 36 to limit the fall distance should a fall occur.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A portable anchorage point assembly for securing an end of a temporary horizontal lifeline to a structure, comprising:

a) a base plate including a top, a bottom, a first side and a second side;

b) a base, said base being operatively connected to said bottom of said base plate;

c) a first strap extending from said first side of said base plate;

d) a second strap extending from said second side of said base plate;

e) a securing member adapted and configured for adjusting and securing said straps about the structure, wherein the securing member is releasably secured about the structure without modifying the structure to secure the straps about the structure; and f) an attachment member operatively connected to said top of said base plate, said attachment member providing means for attaching the end of the horizontal lifeline to said base plate.

2. The portable anchorage point assembly of claim 1, wherein said base has a high coefficient of friction to prevent slippage on the structure.

3. The portable anchorage point assembly of claim 1, wherein said base is an integral part of said base plate.

4. The portable anchorage point assembly of claim 1, wherein said securing member includes a load binder assembly.

5. The portable anchorage point assembly of claim 4, wherein said securing member includes a web sling.

6. A portable anchorage point assembly for use and in contact with a surface of a structure for use with a safety line, comprising:

a) a base plate including a top, a bottom, a first side and a second side;

b) a base, said base being operatively connected to said bottom of said base plate and adapted to contact the surface of the structure to prevent said base plate from sliding on the surface of the structure;

c) a first flexible elongate member extending from said first side of said base plate;

d) a second flexible elongate member extending from said second side of said base plate;

e) a first load binder assembly adapted and configured for adjusting and securing said first flexible elongate member about the structure, wherein the first load binder assembly is releasably secured about the structure without modifying the structure to secure the first flexible elongate member about the structure;

f) a second load binder assembly adapted and configured for adjusting and securing said second flexible elongate member about the structure, wherein the second load binder assembly is releasably secured about the structure without modifying the structure to secure the second flexible elongate member about the structure; and g) an attachment member operatively connected to said top of said base plate, said attachment member providing means for attaching a safety line to said base plate.

7. The portable anchorage point assembly of claim 6, wherein said first flexible elongate member is a first strap and said second flexible elongate member is a second strap.

8. A method of securing an end of a safety line to a structure, comprising:

a) placing a base plate on the structure, said base plate including a top and a base, said base contacting the structure and preventing said base plate from sliding on the structure, said base plate having a first strap and a second strap extending therefrom;

b) securing said first strap and said second strap about the structure, wherein said first strap and said second strap are secured about the structure without modifying the structure; and c) attaching the safety line to an attachment member, said attachment member being proximate said top of said base plate and being operatively connected thereto.

9. A method of securing an end of a temporary horizontal lifeline to a structure having a first side, a second side, and a bottom, comprising the steps of:

a) placing a base plate on the structure, said base plate having a top and a base, said base contacting the structure and preventing said base plate from sliding on the structure;

b) attaching a first strap to a first end of said base plate, said first strap extending from said base plate along the first side of the structure;

c) attaching a second strap to a second end of said base plate, said second strap extending from said base plate along the second side of the structure:

d) securing a first sling about the bottom of the first side of the structure;

e) securing a second sling about the bottom of the second side of the structure;

f) connecting said first sling to said first strap with a first load binder assembly;

g) connecting said second sling to said second strap with a second load binder assembly;

h) tightening said first strap through said first load binder assembly and said second strap through said second load binder assembly thereby fastening said base plate securely to the structure; and i) attaching the end of the temporary horizontal lifeline to the structure.

10. A portable anchorage point assembly for use with a railroad tank car having a first I-beam and a second I-beam for securing an end of a temporary horizontal lifeline thereto, comprising:

a) a base plate including a top, a bottom, a first side and a second side;

b) a base, said base being operatively connected to said bottom of said base plate and adapted to contact the railroad tank car to prevent said base plate from sliding about on the railroad tank car, c) a first strap operatively connected to said first side of said base plate;

d) a second strap operatively connected to said second side of said base plate;

e) a first web sling, said first web sling adapted to be secured about the first I-beam;

f) a second web sling, said second web sling adapted to be secured about the second I-beam;

g) a first load binder assembly interconnecting said first strap and said first web sling;

h) a second load binder assembly interconnecting said second strap and said second web sling; and i) an attachment member, said attachment member being operatively connected to said base plate, said attachment member providing a surface to which the end of the temporary horizontal lifeline may be attached and secured thereto.

11. The portable anchorage point assembly of claim 10, wherein each of said first load binder assembly and said second load binder assembly include a snap hook and a load binder.

12. A portable anchorage point assembly for securing an end of a temporary horizontal lifeline to a structure, comprising:

a) a base plate including a top, a bottom, a first side and a second side;

b) a base, said base being operatively connected to said bottom of said base plate;

c) a first strap extending from said first side of said base plate;

d) a second strap extending from said second side of said base plate;

e) a securing member adapted and configured for adjusting and securing said straps about the structure, wherein the securing member is releasably secured about the structure without modifying the structure to secure the straps about the structure; and f) an attachment member, said attachment member being operatively connected to said base plate, said attachment member providing a surface to which the end of the temporary horizontal lifeline may be attached and secured thereto.

* * * * *